US009604493B2

(12) United States Patent
Van Gorp et al.

(10) Patent No.: US 9,604,493 B2
(45) Date of Patent: Mar. 28, 2017

(54) METHOD AND SYSTEM TO MANUFACTURE AN INTEGRATED RETURN MAILPIECE ON WRAPPING DOCUMENT PROCESSING SYSTEM

(75) Inventors: Mark Van Gorp, Cary, NC (US); Elizabeth L. Manning, Raleigh, NC (US)

(73) Assignee: Bell and Howell, LLC, Durham, NC (US)

( * ) Notice: Subject to any disclaimer, the term of this patent is extended or adjusted under 35 U.S.C. 154(b) by 1517 days.

(21) Appl. No.: 12/642,258

(22) Filed: Dec. 18, 2009

(65) Prior Publication Data

US 2011/0121064 A1 May 26, 2011

Related U.S. Application Data

(60) Provisional application No. 61/264,453, filed on Nov. 25, 2009.

(51) Int. Cl.

| | |
|---|---|
| ***B65B 11/48*** | (2006.01) |
| ***B43M 5/04*** | (2006.01) |
| ***B42D 5/02*** | (2006.01) |
| ***B42D 15/08*** | (2006.01) |
| ***B65D 27/06*** | (2006.01) |

(52) U.S. Cl.

CPC ..... *B43M 5/047* (2013.01); *B42D 5/026* (2013.01); *B42D 15/08* (2013.01); *B65D 27/06* (2013.01)

(58) Field of Classification Search

CPC ..... B43M 5/047; B42D 5/026; B42D 15/08; B65D 27/06

USPC ..... 53/460, 131.4, 411, 569, 206, 131.2; 493/216, 188

See application file for complete search history.

(56) References Cited

U.S. PATENT DOCUMENTS

| | | | | |
|---|---|---|---|---|
| 2,279,164 | A * | 4/1942 | Gettleman | 283/56 |
| 2,910,222 | A | 10/1959 | Bermingham, Jr. et al. | |
| 3,941,309 | A * | 3/1976 | Gendron | 229/301 |
| 3,955,751 | A | 5/1976 | Mayne | |
| 4,437,852 | A | 3/1984 | Volk, Jr. et al. | |
| 4,524,903 | A * | 6/1985 | Vath | 229/303 |
| 4,668,211 | A * | 5/1987 | Lubotta et al. | 493/188 |
| 4,669,652 | A * | 6/1987 | Seguin | 229/303 |

(Continued)

FOREIGN PATENT DOCUMENTS

| | | |
|---|---|---|
| EP | 0 261 843 A2 | 3/1988 |
| EP | 0 712 782 A1 | 5/1996 |
| FR | 2503671 | 4/1981 |

OTHER PUBLICATIONS

Ecoenvelopes website, Oct. 9, 2009. <http://ecoenvelopes.com/index.php?page=products>.

(Continued)

*Primary Examiner* — Sameh Tawfik

(74) *Attorney, Agent, or Firm* — Jenkins, Wilson, Taylor & Hunt, P.A.

(57) ABSTRACT

The present teachings relate to methods and systems for preparing an integrated mailpiece using a document processing system such as a wrapping document processing system. The manufactured mailpiece is an integrated bidirectional mailpiece having outgoing and return envelope functionality. In the outgoing format, the integrated mailpiece may optionally contain advertisements, coupons, inserted documents, statements or payment coupons.

10 Claims, 10 Drawing Sheets

(56) References Cited

U.S. PATENT DOCUMENTS

| | | | | | |
|---|---|---|---|---|---|
| 4,726,802 | A | * | 2/1988 | Volk, Jr. | 493/188 |
| 4,756,468 | A | * | 7/1988 | Jenkins | 229/304 |
| 4,896,823 | A | * | 1/1990 | Taylor | 229/303 |
| 4,915,287 | A | | 4/1990 | Volk et al. | |
| 4,928,875 | A | | 5/1990 | Hutchinson | |
| 5,015,137 | A | | 5/1991 | Stenner | |
| 5,052,977 | A | * | 10/1991 | Irvine | 462/6 |
| 5,076,489 | A | * | 12/1991 | Steidinger | 229/71 |
| 5,104,036 | A | | 4/1992 | Rutowski et al. | |
| 5,169,060 | A | * | 12/1992 | Tighe et al. | 229/301 |
| 5,174,493 | A | | 12/1992 | File | |
| 5,174,494 | A | | 12/1992 | Ashby | |
| 5,201,464 | A | | 4/1993 | File | |
| 5,289,972 | A | | 3/1994 | Sauerwine | |
| 5,352,177 | A | | 10/1994 | Walter | |
| 5,372,302 | A | | 12/1994 | Loch | |
| 5,398,867 | A | * | 3/1995 | Murphy | 229/69 |
| 5,402,934 | A | | 4/1995 | Sauerwine | |
| 5,425,500 | A | | 6/1995 | Sauerwine | |
| 5,513,795 | A | | 5/1996 | Sauerwine | |
| 5,553,774 | A | | 9/1996 | Goodno | |
| 5,598,970 | A | | 2/1997 | Mudry | |
| 5,794,409 | A | * | 8/1998 | Akridge et al. | 53/460 |
| 5,865,717 | A | * | 2/1999 | Fabel | 493/216 |
| 5,893,512 | A | | 4/1999 | Diedrich | |
| 5,997,457 | A | * | 12/1999 | Stenner | 493/216 |
| 6,041,999 | A | | 3/2000 | Petkovsek | |
| 6,053,855 | A | | 4/2000 | Stenner | |
| 6,224,530 | B1 | | 5/2001 | Okelmann et al. | |
| 6,412,687 | B1 | | 7/2002 | Steitz | |
| 6,431,437 | B1 | | 8/2002 | Lombardo et al. | |
| 6,893,387 | B1 | * | 5/2005 | Dahlquist | 493/216 |
| 7,100,348 | B2 | * | 9/2006 | Mertens | 53/460 |
| 7,231,750 | B2 | | 6/2007 | Woodman et al. | |
| 7,254,931 | B2 | | 8/2007 | Stemmle et al. | |
| 7,699,352 | B2 | | 4/2010 | Stemmle et al. | |
| 8,544,720 | B2 | | 10/2013 | Van Gorp et al. | |
| 2002/0008135 | A1 | | 1/2002 | Kim | |
| 2002/0038817 | A1 | | 4/2002 | Black | |
| 2005/0224566 | A1 | | 10/2005 | Butler | |
| 2006/0182918 | A1 | | 8/2006 | Dahbura et al. | |
| 2006/0266808 | A1 | | 11/2006 | DeLaVergne | |
| 2007/0131739 | A1 | | 6/2007 | Ponti | |
| 2011/0121064 | A1 | | 5/2011 | Van Gorp et al. | |
| 2011/0192892 | A1 | | 8/2011 | Van Gorp et al. | |
| 2014/0001251 | A1 | | 1/2014 | Van Gorp et al. | |

OTHER PUBLICATIONS

Extended European Search Report, issued in European Patent Application No. 11153264.4 dated Apr. 13, 2011.

United States Office Action issued in U.S. Appl. No. 12/702,696 dated Jun. 21, 2012.

United States Office Action issued in U.S. Appl. No. 12/642,539 dated Apr. 5, 2012.

Labeled diagrams of "Opened envelope with return envelope and payment coupon," "Paper sheet with return envelope open," and "Envelope as mailed to car owner," 3 pages.

Declaration for Compliance with Duty of Disclosure Under 37 C.F.R. 37 C.F.R. § 1.56 executed by Walter S. Conard on Jul. 13, 2012.

Exhibit 1: Declaration of Walter S. Conard, Renewal Notice from Illinois DMV to Walter S. Conard, 2009.

United States Office Action issued in U.S. Appl. No. 12/642,539 dated Apr. 26, 2013.

Entire Prosecution History of U.S. Appl. No. 12/702,696, filed Feb. 9, 2010 entitled Mailpiece With 8 Personalized Communication and Return Slip and Related Method Utilizing Wrapper System.

Restriction Requirement for U.S. Appl. No. 12/642,539 dated Feb. 13, 2012.

Restriction Requirement for U.S. Appl. No. 12/702,696 dated Mar. 1, 2012.

Final Office Action for U.S. Appl. No. 12/642,539 dated Sep. 7, 2012.

Final Office Action for U.S. Appl. No. 12/702,696 dated Mar. 1, 2013.

Examiner's Answer in response to the Appeal Brief filed on Feb. 28, 2013, issued in U.S. Appl. No. 12/642,258 dated May 28, 2013.

Notice of Allowance for U.S. Appl. No. 12/642,539 dated Jul. 29, 2013.

Restriction Requirement for U.S. Appl. No. 14/015,637 dated Jun. 17, 2015.

Non-Final Office Action for U.S. Appl. No. 14/015,637 dated Nov. 10, 2015.

Office Action for EP Application 11153264 dated Apr. 12, 2016.

Buckle Folder video, http://www.youtube.com/watch?v=u8MyaOFxTJY uploaded Sep. 8, 2007.

Inveloper video, http://www.youtube.com/watch?v=Vw_JqE8bDO8 published Oct. 17, 2012.

Final Office Action for U.S. Appl. No. 14/015,637 dated Jun. 13, 2016.

* cited by examiner

METHOD AND SYSTEM TO MANUFACTURE AN INTEGRATED RETURN MAILPIECE ON WRAPPING DOCUMENT PROCESSING SYSTEM

RELATED APPLICATIONS

This application claims the benefit of U.S. Provisional Application No. 61/264,453 filed Nov. 25, 2009, the disclosure of which is entirely incorporated herein by reference.

This application is related to copending application Ser. No. 12/642,539 (now U.S. Pat. No. 8,544,720) filed on Dec. 18, 2009, entitled ARTICLE OF MANUFACTURE FOR USAGE AS AN INTEGRATED BIDIRECTIONAL MAILPIECE AND METHOD OF MANUFACTURING INTEGRATED BIDIRECTIONAL MAILPIECES the disclosure of which is entirely incorporated herein by reference.

TECHNICAL FIELD

The present subject matter relates to techniques and equipment to print forms that can be used in a document processing system that individually wraps each form in a manner that produces a mailpiece that is both an outbound (i.e. going to a customer) and a return mailpiece (i.e. returned to a business). In addition, the printed form may optionally contain advertisements, coupons, inserted documents, statements and payment coupons.

BACKGROUND

Current mail production operations have seen many changes and trends over the past decade, including increases in costs, shrinking margins, lower volumes, market consolidation, changing postal regulations, and increased competition. What has remained constant, however, is the need to produce communication pieces that derive a desired response, and are produced with integrity and in a highly automated and efficient manner.

The current systems that mailers use for creating the majority of their work range from low-speed inserters with no intelligence to high-speed finishing systems that are intelligent and connected to some form of an automated document factory. The systems used are typically determined by the application being processed and the capital investment available for growth.

Existing inserting systems have many factors that determine their overall speed and efficiency. Even high-end systems have limitations that prevent them from realizing their maximum potential. These limitations include: the number of supported input channels; the speed at which materials are personalized and assembled; and the number of stops from jams or other errors; the rate at which inserts can be added.

Current document processing approaches involve creating a document, such as a statement, to be folded and inserted into a pre-manufactured envelope. The envelope is frequently windowed to allow the address printed on the document to be seen through the window. This approach is favored for personal mail versus printing the address after the mailpiece manufacture is completed. The window approach is used to insure that the contents of the mailpiece and address match. In addition, coupons and inserts are separately printed and cut and matched with the document prior to insertion into the windowed envelope. Frequently, a return mail envelope is separately manufactured and inserted into the envelope with the other material. This process and inserter system are very complex with multiple feeders and cutters and numerous pieces of material that need to be manufactured in separate processes and loaded numerous times on to the inserter.

Hence a need exists for a mail preparation process that uses a prepared group of forms printed on a paper roll which is processed on a wrapping document processing system that eliminates the separate steps mentioned above to create a multi-function mailpiece.

SUMMARY

It is desirable to provide an article of manufacture for use as an integrated bidirectional mailpiece having outgoing and return envelope functionality. The article includes a sheet of paper having printed material on first and second sides of the paper. The paper includes a first panel having a first address for the outgoing envelope; a second panel including a second address for the return envelope, with the second address being different from the first address; a third panel between the first and second panels. At least one adhesive region is positioned on at least one side of the paper. At least one fold line extends across a width of the paper between the first and second panels. At least one perforated line extends across a width of the paper for separating the first panel from the paper.

It is further desirable to provide a method of creating an integrated bidirectional mailpiece having outgoing and return envelope functionality. The method includes printing information on both sides of a paper. The paper having a first panel including a first address for the outgoing envelope; a second panel including a second address for the return envelope, the second address being different from the first address; and a third panel between the first and second panels. The paper is folded along fold lines to form the mailpiece such that the address on the first panel is viewable on an exterior of the mailpiece, and the address on the second panel is concealed in an interior of the mailpiece. The folded paper is sealed along one or more adhesive portions positioned along one or more surfaces of the mailpiece.

It is yet further desirable to provide a method for producing a bidirectional integrated mailpiece having outgoing and return envelope functionality. The method includes receiving a continuous web of pre-printed paper from a paper stock. The pre-printed paper contains a first address for the outgoing envelope in a first panel and a second address for a return envelope in a second panel. At least one adhesive region is applied to a surface of at least one side of the sheet of paper. At least one fold line is created and extends across a width of the sheet of paper between the first and second panels. A perforated line is generated and extends across a width of the paper such that the first panel can be separated from the paper. The paper is folded along a plurality of fold lines such that the first address on the first panel is viewable on an exterior of the mailpiece. The second address on the second panel is concealed in an interior of the mailpiece. The folded paper is sealed along one or more adhesive portions to form the mailpiece.

In yet another example, a method for producing an article of manufacture for use as an integrated bidirectional mailpiece having outgoing and return envelope functionality is provided. The method includes receiving paper from a paper stock. A first address is printed on a first panel for the outgoing envelope. A second address is printed on a second panel for the return envelope, with the second address being different from the first address. One or more adhesive regions is applied to a surface of at least one side of the paper. At least one fold line is created and extends across a width of the sheet of paper between the first and second panels. A perforated line is generated and extends across a width of the paper such that the first panel can be separated from the paper.

It is further desirable to provide a system for generating a bidirectional integrated mailpiece having outgoing and return envelope functionality. The system includes a printer configured to print information on at least one side of a sheet of paper. The sheet of paper includes a first address on a first panel for the outgoing envelope and a second address on a second panel for the return envelope, with the second address being different from the first address. A glue applicator is configured to apply one or more adhesive regions on at least one side of the sheet of paper. A perforator is configured to create a perforated line extending across a width of the paper between the first and second panels. A folder is configured to fold the sheet of paper along one or more fold lines such that the first address on the first panel is viewable on an exterior of the mailpiece, and the second address on the second panel is concealed in an interior of the mailpiece.

Additional objects, advantages and novel features will be set forth in part in the description which follows, and in part will become apparent to those skilled in the art upon examination of the following and the accompanying drawings or may be learned by production or operation of the examples. The objects and advantages of the present teachings may be realized and attained by practice or use of the methodologies, instrumentalities and combinations particularly pointed out in the appended claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

The present teachings alleviate one or more of the above noted problems by providing a process to provide an integrated mailpiece using a document processing system such as a wrapping document processing system. The manufactured mailpiece is an integrated bidirectional mailpiece having outgoing and return envelope functionality. In the outgoing format, the integrated mailpiece may optionally contain advertisements, coupons, inserted documents, statements or payment coupons. Other documents may be added to the mailpiece as inserts.

A plurality of forms containing the group of items listed above are aggregated and printed on a paper roll. Some types of glue strips and perforation tear or fold lines maybe added to the roll of paper before it enters the printer or immediately after printing. The finished printed roll of paper is processed on a wrapping document processing system that will add glue strips and perforations as needed and wrap the prepared paper along fold lines to form an integrated bidirectional mailpiece with outbound and return mailpieces. The resulting strip of paper is cut to form the individual outbound mailpieces. The outbound mailpiece may optionally contain other documents which may be added as inserts.

The present teachings provide an eco-friendly document processing system that dynamically is capable of creating personalized bills and statements at significant savings over conventional mailpieces. The present system enables the creation of documents in all standard formats on a single machine, delivers significant improvements in efficiency, and dramatically reduces paper costs and usage.

In certain examples, the present teachings provide for document processing system uses roll-fed material to create an integrated bidirectional mailpiece that replaces the traditional elements in a statement or invoice: the outgoing envelope, statement, optional promotional inserts, remittance and return envelope. Thus, conventional outgoing and return envelopes are eliminated through the present document processing system and waste associated with shipping, storing, handling, and printing of these conventional materials is also avoided.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

Figure 1:
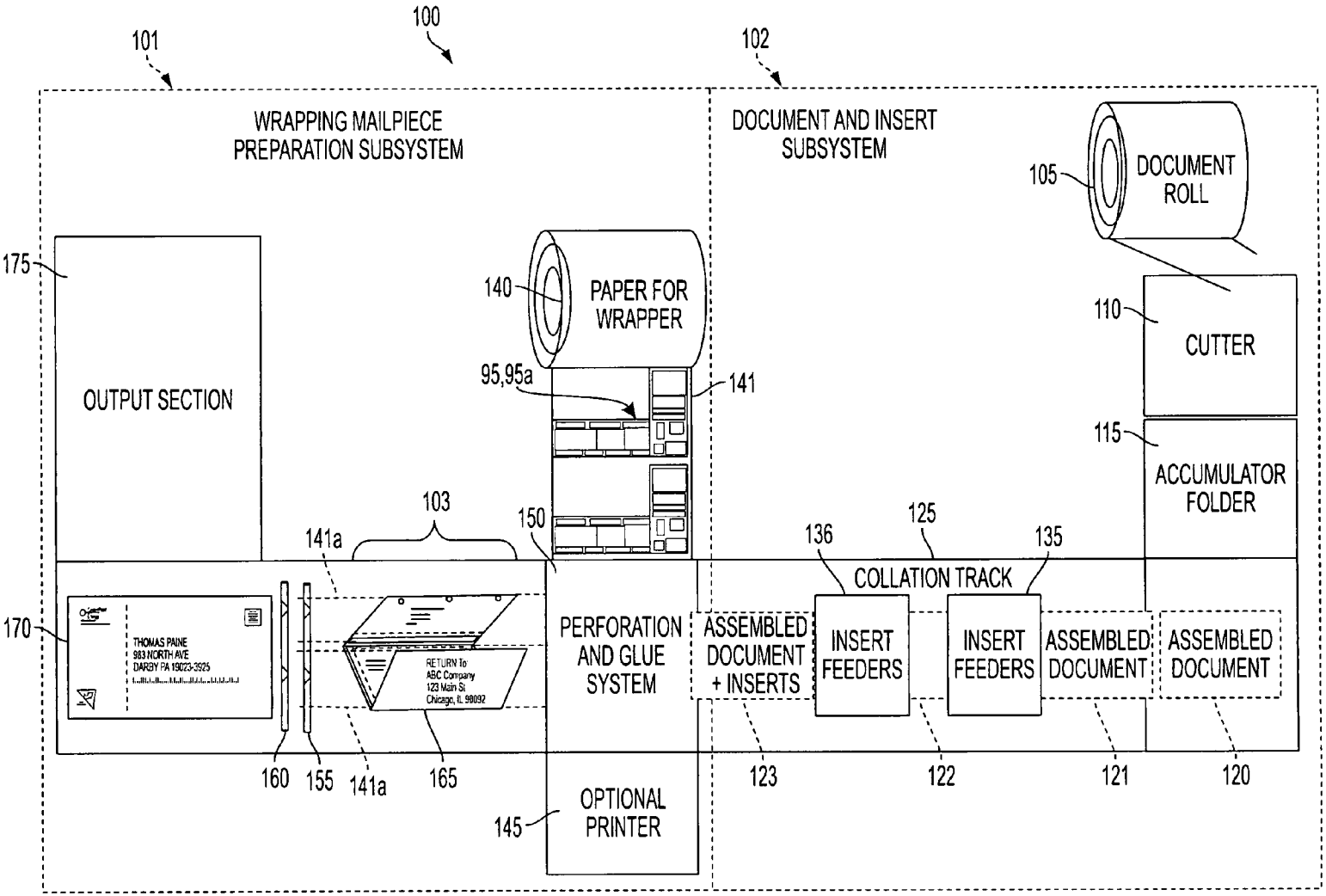
FIG. 1 is a diagram of a wrapping document processing system that can create a multi-function mailpiece from single page forms printed on a paper roll.

Reference now is made in detail to the examples illustrated in the accompanying drawings and discussed below. FIG. 1 illustrates a wrapping document processing system 100. As illustrated, there are two major subsystems 101 and 102. The first subsystem is the wrapping mailpiece preparation subsystem 101, which forms a bidirectional mailpiece 170 from a single page form (FIGS. 2A, 2B; 4A, 4B or 5), that originate on a paper roll 140. The Bowe Bell+Howell MAILStream Inveloper is an example of a machine that contains the technology needed to configure the wrapping mailpiece preparation subsystem 101 plus the insert feeders 136 and 135 of the document and insert subsystem 102. A bidirectional mailpiece is characterized by the formation of both an outbound mailpiece and a return mailpiece which is created from numerous single page forms printed on a continuous roll of paper. The bidirectional mailpiece is not cut from the continuous web of paper 141 containing a stream of printed forms 95 or 95*a* until the mailpiece 170 is completed. The document and insert subsystem 102 is the second subsystem. This subsystem is optional to the formation of a bidirectional mailpiece 170 however; this subsystem 102 can be readily integrated onto the wrapping mailpiece preparation subsystem 101. The subsystems 101 and 102 may or may not be under the control of one or more control processors 200, which coordinates and controls the actions of one or more devices within the subsystems 101 and 102.

Figure 2B:
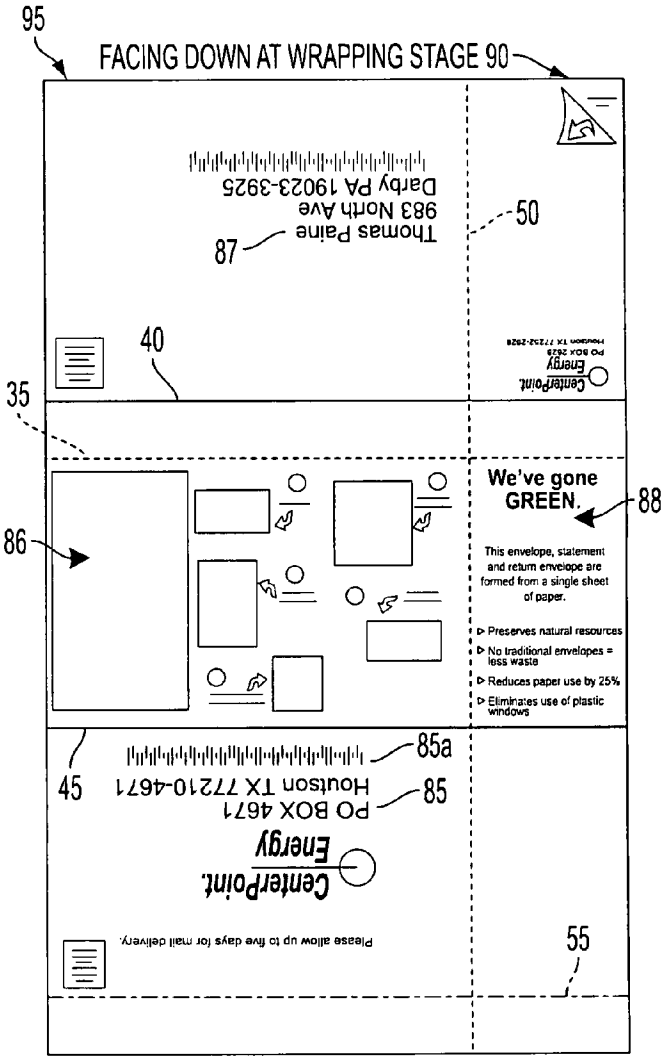
FIGS. 2A and 2B are an exemplary single page forms for the inside and outside of a mailpiece, respectively.

The wrapping mailpiece preparation subsystem, referred as subsystem 101 hereafter, is designed to take pre-print forms 95 or 95*a* on a paper roll 140 and prepare the roll of paper 140 to be formed into a bidirectional mailpiece. Details of the form are discussed in FIGS. 2A and 2B. The continuous web of paper 141, from the paper roll 140, is fed under the perforation and glue section 150 to an optional printer 145. Additional data can be printed on the forms as the web passes through the printer 145. For example, if the forms 95 or 95*a* did not contain any customer specific data then the customer's address maybe printed by the printer 145. Mailpiece designers skilled in the art can add any required additional printed data as desired with the printer 145 option. The continuous web 141 proceeds to the perforation and glue section 150 where various glue types are applied and longitudinal perforations are added as required. FIG. 3 provides additional detail for the operation of the perforation and glue section 150. The continuous web 141 is reoriented in direction by 90 degrees in the perforation and glue section 150 and fed into the wrapping section 103 where individual panels 92, 94 are wrapped along the fold lines 40 and 45, as shown in FIGS. 2A and 2B.

Following the wrapping step 103, which also seals any pressure sensitive or contact glue strips, the completed out bound mailpiece 165, which is still a part of the continuous web 141, goes into a set of perforation rollers 155 and then into a set of cutter rollers 160 for cutting the out bound mailpiece 165 from the wrapped (folded) continuous web 141*a* to form the finished mailpiece 170. The finished mailpieces 170 will be transferred to the output section 175 where the finished mailpieces will be stacked and grouped into mail trays, either automatically or with operator assistance. The perforation rollers 155 can be designed in numerous styles based on the positioning of the perforation cutters. These variations make it possible to cut all layers of the outbound mailpiece 170, cut only selected layers and to limit the perforation cuts to only a partial section instead of the full width.

The document and insert subsystem 102 is required if inserts are desired to be part of the outbound mailpiece 170. Documents are either on a roll of paper 105 or in a fan folded stack of paper. The documents are fed into a cutter 110 to make individual sheets and then into an accumulator folder 115 to accumulate multiple sheets that make up the document and then fold the sheets into a form facter compatable with the space available in the wrapped return mailpiece. The Bowe Bell+Howell 310 High Speed Cutter and the 4911 Combined Accumulator/folder are representative to the technology required for items 110 and 115 respectively. The assembled document 120 is placed on a collation track 125. The collation track 125 will advance the document 121 under an insert feeder 135 where an insert will be added to form a collection material including inserts and a document 122. If additional inserts are required, additional feeders 136 are used to add inserts 123 to the collection of material to be wrapped into the out bound mailpiece 165.

Figure 2A:
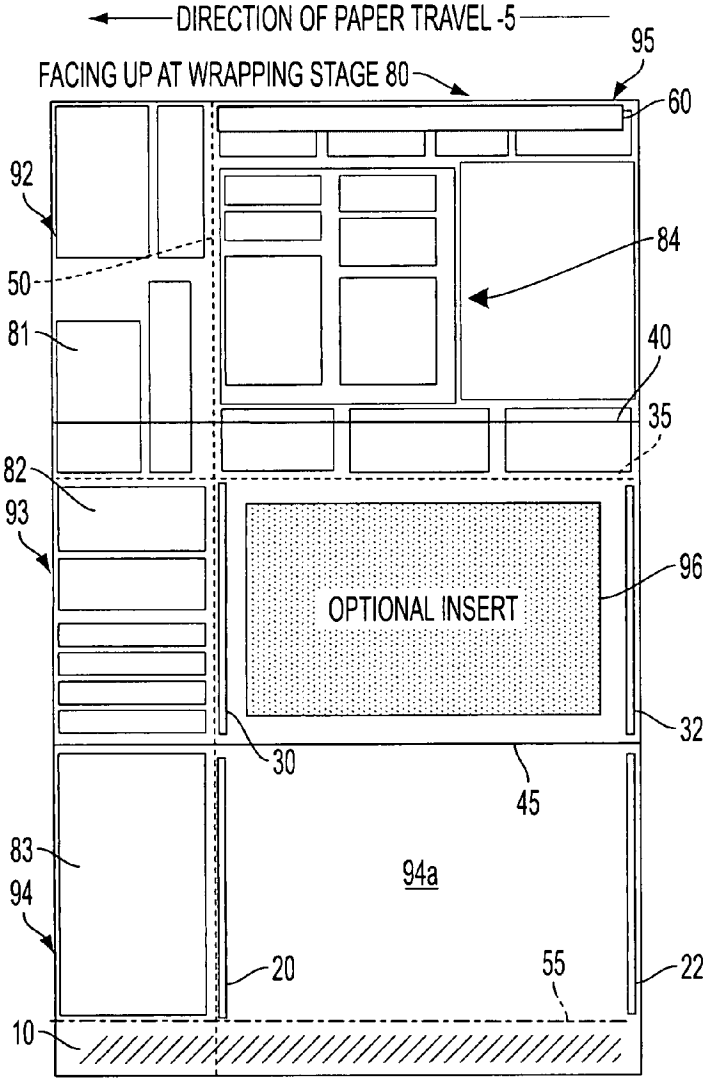
Figure 3:
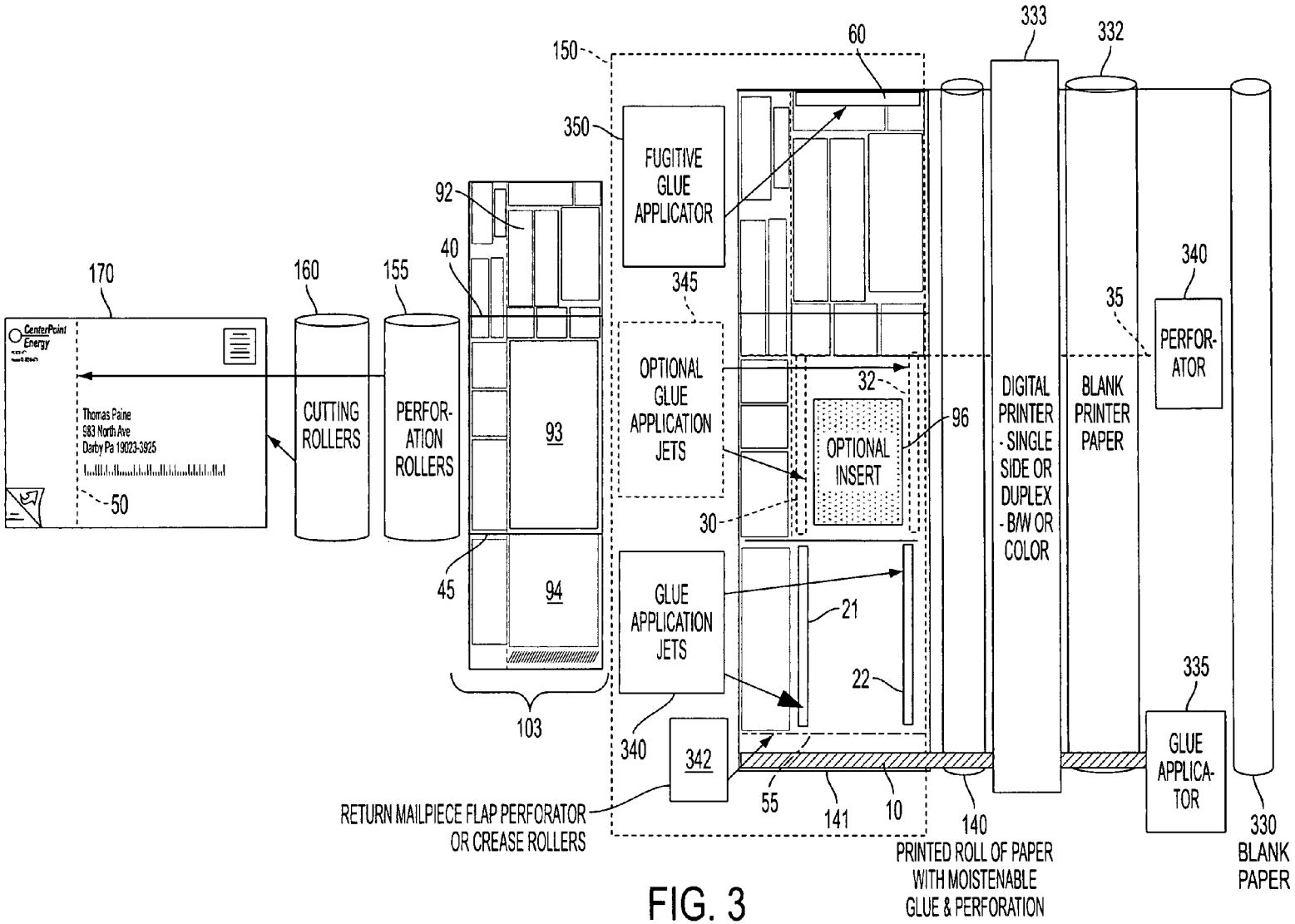
FIG. 3 is a diagrammatic representative of the components of the system needed to create the multi function mailpiece.
Figure 4B:
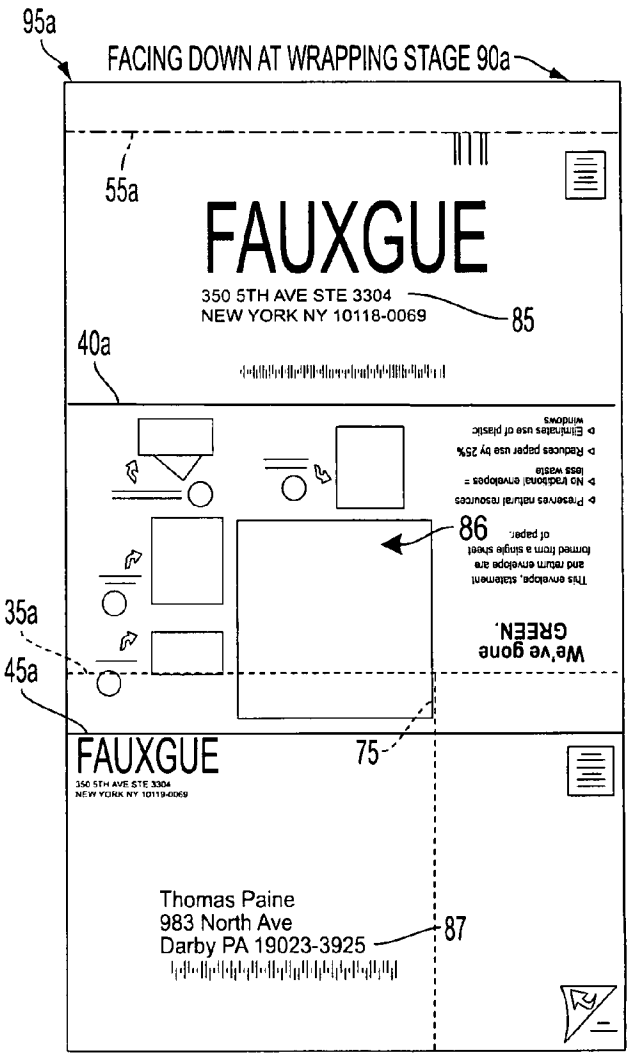
FIGS. 4A and 4B are exemplary single page forms for the inside and outside of a mailpiece, respectively.
Figure 4A:
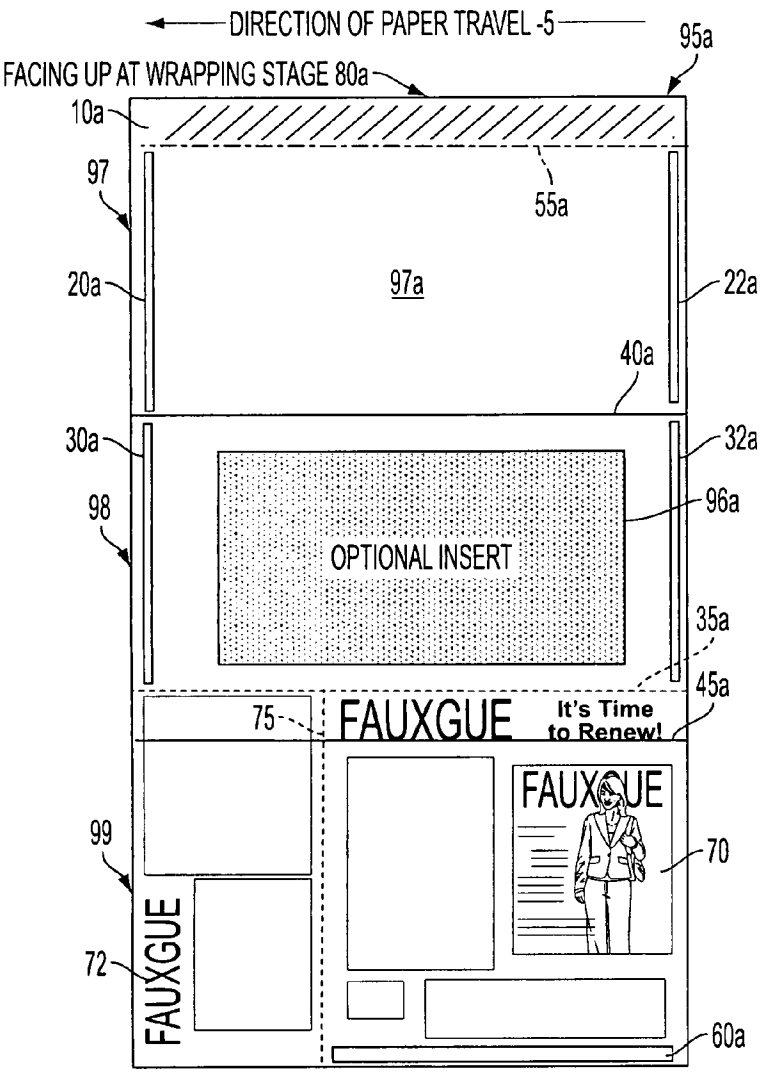
Figure 5:
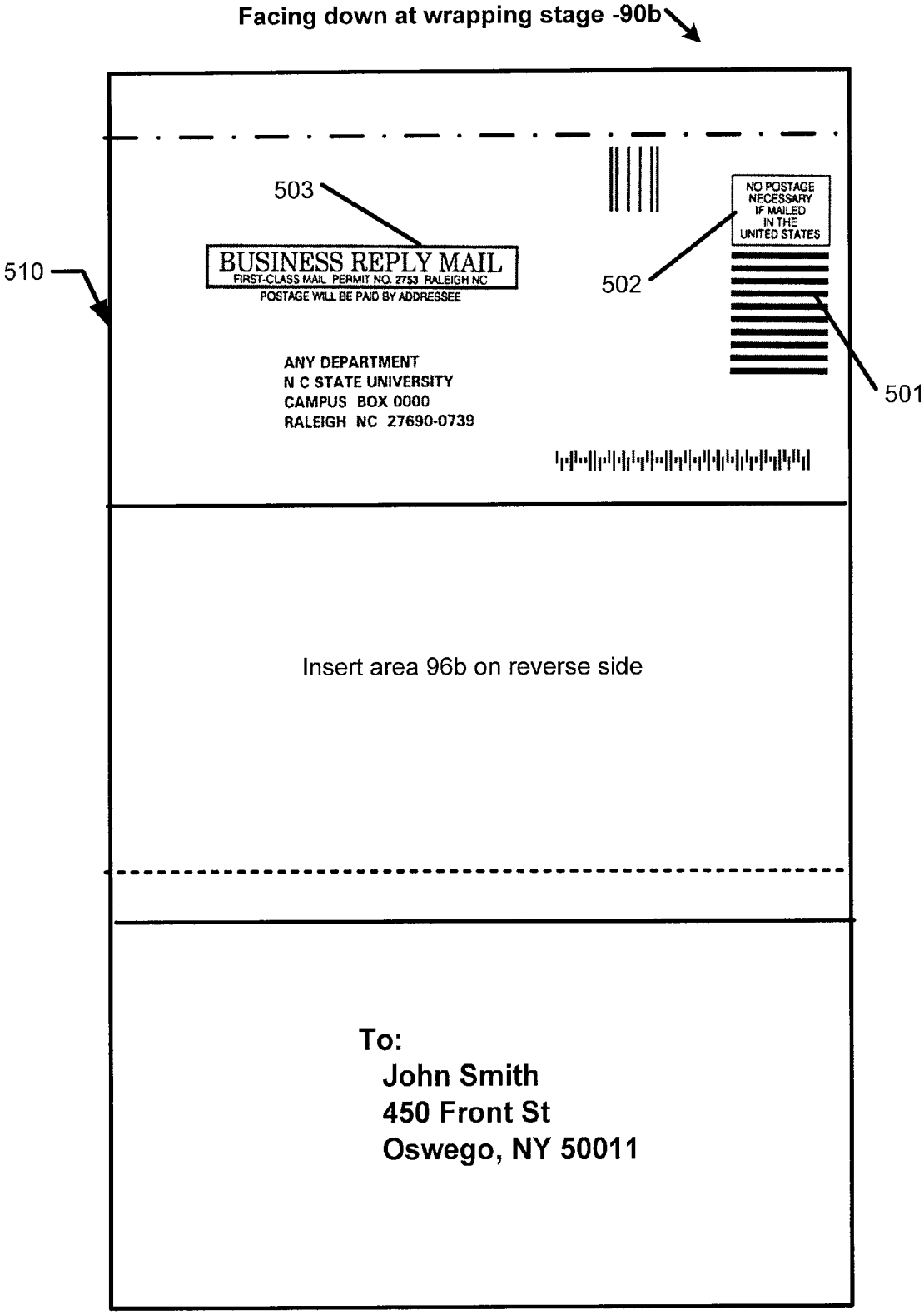
FIG. 5 is an exemplary return mailpiece showing the markings required for business reply mail.

The collation track 125 is either moving the documents at the same speed as the paper web 141 or synchronizes the speed of the last group of inserts and document 123 so that the inserts and document can be placed onto the correct area of the center panel 93 or 98 (optional insert positions 96, 96*a* and 96*b* in FIGS. 2A, 4A and 5, respectively). The components and features of both the wrapping mailpiece preparation subsystem 101 and the document and insert subsystem 102 can be reconfigured, by those skilled in the art, to support numerous bidirectional mailpiece designs that are suitable for operation on a wrapping document processing system 100.

Figure 1A:
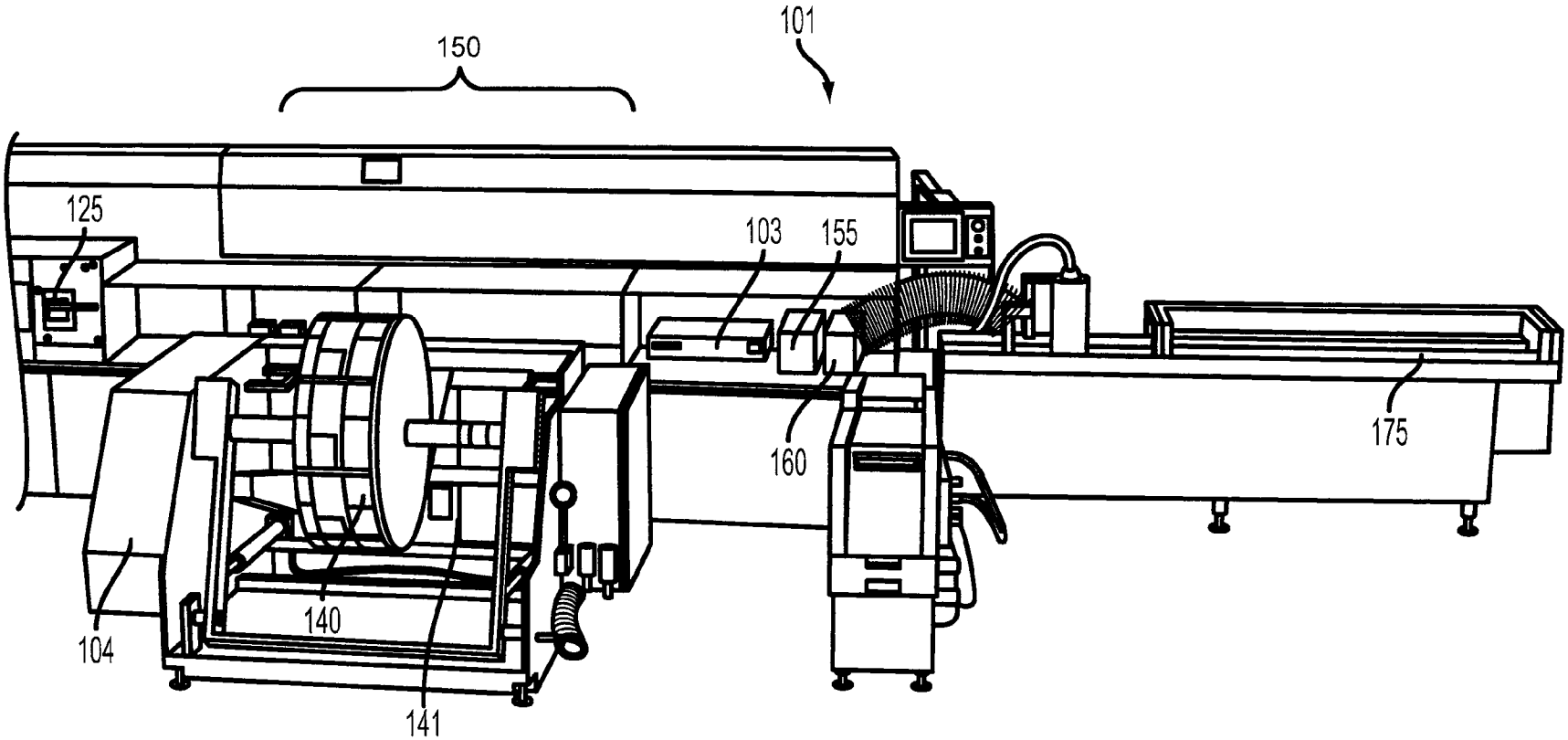
FIG. 1A is a representation of a wrapping document processing system with emphasis on the wrapping mailpiece preparation subsystem.

In FIG. 1A, a representation of a wrapping document processing system with emphasis on the wrapping mailpiece preparation subsystem 101 is shown. The majority of FIG. 1A is devoted to the wrapping mailpiece preparation subsystem 101 with only the trailing edge of the collation track 125 shown for the document and insert subsystem 102. The paper roll 140 is shown installed on the support and unwind mechanism 104 with the paper web 141 entering the perforation and glue system 150. The optional printer is not shown as well as the sub-components of the peroration and glue system 150. A portion of the wrapping section 103 is visible next the perforation rollers 155 and the cutting rollers 160. The output section is not shown but it attached at location 175.

Referring to FIGS. 2A and 2B for an exemplary illustration of form 95 that demonstrates many of the features that maybe included in the bidirectional mailpiece. FIG. 2A shows the face up side of the form 80 as it comes off the paper roll 140 and as it transitions into the wrapping section 103. The direction of travel through the machine is indicated by arrow 5. FIG. 2B is the face down side of the form 90 as it comes off the paper roll 140 and as it transitions into the wrapping section 103. To correctly visualize the face down or backside of the form 90 as it is duplex printed, rotate form 90 counterclockwise under the upward facing form 80. As a result, the printed material 86 is directly underneath the optional insert 96 section of form 80. The form 80 is divided into three panels 92, 93 and 94 which will be folded in the wrapping section 103. Each panel can contain a variety of options for the printed material. The examples in FIGS. 2A and 2B are not intended to be limiting in nature and are provided as possible examples. The sample form 95 is an example of an electric bill with a statement 84 and a payment coupon 81 that are primarily on panel 92, but overlap across the fold line 40 into panel 93. Perforation 35 is produced either during the preparation of the printer ready roll of paper 332 (FIG. 3) or is added by a perforation wheel in the perforation and glue section 150. Perforation 35 is needed to enable the customer to remove the statement from what will become the return envelope in the wrapping section 103. The bottom side of panel 92 is the customer address 87.

The return mailpiece is created with panels 93 and 94. Printed information is provided to the customer in the form of additional company information 82 and a coupon 83. Those skilled in the art, may provided printed material on the inside of the return envelope at location 94*a* that will be used when the return envelope is processed at the receiving location. The bottom side of panel 93 contains instructions 86 on opening the mailpiece and making a payment with the payment coupon and a method of payment such as a check. Additional information 88 can be printed in the back side of panel 93. The printed information in sections 81, 82, 84, 84, 86 and 88 can be used for numerous purposes, such as, but not limited to statements, advertisements, coupons, customer alerts and instructions, depending on the type of mailpiece being generated. The return address 85 is printed on the bottom side of panel 94. Glue strips are applied in the perforation and glue section 150. If pressure glue is used, either glue strips 30 and 32 or 20 and 22 are applied. Both strips are not needed for pressure sensitive glue. Other glue options are possible such as contact glue which will only bind when the opposite glue strip comes in contact. In this case, all four strips maybe applied. If optional inserts 96 are required they are placed on the panel 93 before the wrapping section 103 (FIG. 1). With either glue option, the return mailpiece will be formed by the wrapping section 103 where panel 94 will be folded onto panel 93 and the glue pressure sealed. The glue is applied with a jet system or a roller with a glue applicator. Those skilled in the art will adapt existing application technology based on the application requirements. A moistenable glues strip 10 is applied to the paper roll 330 (FIG. 3) where sufficient drying time is allotted or the moistenable glues strip 10 can be applied in the perforation and glue section 150. If the glue is applied in section 150, a heat source or forced air maybe added to ensure that the glue is dry before the paper web 141 reaches the wrapping section 103. The moistenable glue is part of the return mailpiece flap that is made by applying a fine perforation or by adding a crease with opposing rollers to form the flap fold line 55. The outbound mailpiece 170 is formed by first wrapping panel 94 on top of panel 93 to form the return mailpiece and then wrapping panel 92 along fold line 40. A fugitive glue strip 60 is applied to panel 92 in the perforation section 150 to seal panel 92 to the folded bottom side of panel 94. As a reference, the fugitive glue will adhere to panel 94 below the barcode 85*a*. This is the final step in the wrapping section 103. Fugitive glue is an easily removed glue with low adhesion, similar to the glue on a Post-It® note. However, fugitive glue as used in this application is not intended to re-adherable. Glue spots maybe used in place of a glue strip 60. Following the wrapping section 103, perforation rollers are used to form the perforation line 50 by cutting perforations through the closed mailpiece. The out bound mailpiece 170 is cut from the continuous web 141*a* with cutter rollers 160.

FIG. 3 identifies an exemplary illustration of the component parts needed to form a bidirectional mailpiece 170. The processes as identified maybe performed by separately run processes done at different times or even by different companies. The process starts with a blank paper roll 330. Perforations 35 and moistenable glue strips 10 maybe applied to the blank roll of paper 330 with a perforation wheel system 340 and glue applicator 335 respectively. Depending on the production setup, the paper web from roll 330 maybe re-rolled 332 after the glue has dried or sent directly into the printer 333. The printer 333 maybe duplex and color as required for forms 95 and 95*a* FIGS. 2A, 2B and 4A, 4B respectively or single sided black and white as illustrated for form 90*b* FIG. 5. The printer output is rerolled 140 for use by the wrapping document processing system 100 or fed directly into the system 100. The optional printing system 145 is not shown.

The subcomponents of the perforation and glue system 150 have numerous component types and features that are available and configurable by those skilled in the art to perform the functions dictated by the form to be processed. The functions of system 150 illustrated in FIG. 3 are in reference to form 95 FIGS. 2A, 2B. A fugitive glue applicator 350 applies the glue strip 60 to the statement portion. Spraying, wiping, and rolling glue onto the paper web are common methods but the application process is not limited to these methods. Optional glue lines 30 and 32 are applied with spraying system 345. These glue lines are often omitted since they may interfere with the inclusion of the optional inserts 96 by the document and insert subsystem 102. A glue applicator 340 applies the pressure sensitive glue strips 21 and 22. The fold line 55 for the return mailpiece flap is created by a very fine perforator or crease rollers 342. Either method will make it easy for the customer to fold the flap along the fold line 55. The wrapping section 103 will accept the inserts 96 and fold panel 94 along fold line 45 onto panel 93 and seal the pressure sensitive glue strips 21 and 22. The next stage wraps panel 92 on top of panel 94 and seals the fugitive glue. Crosswise perforations 50 are created by the perforation rollers 155 and then the outbound mailpiece is cut from the continuous web 141*a* with cutter rollers 160.

Figure 3A:
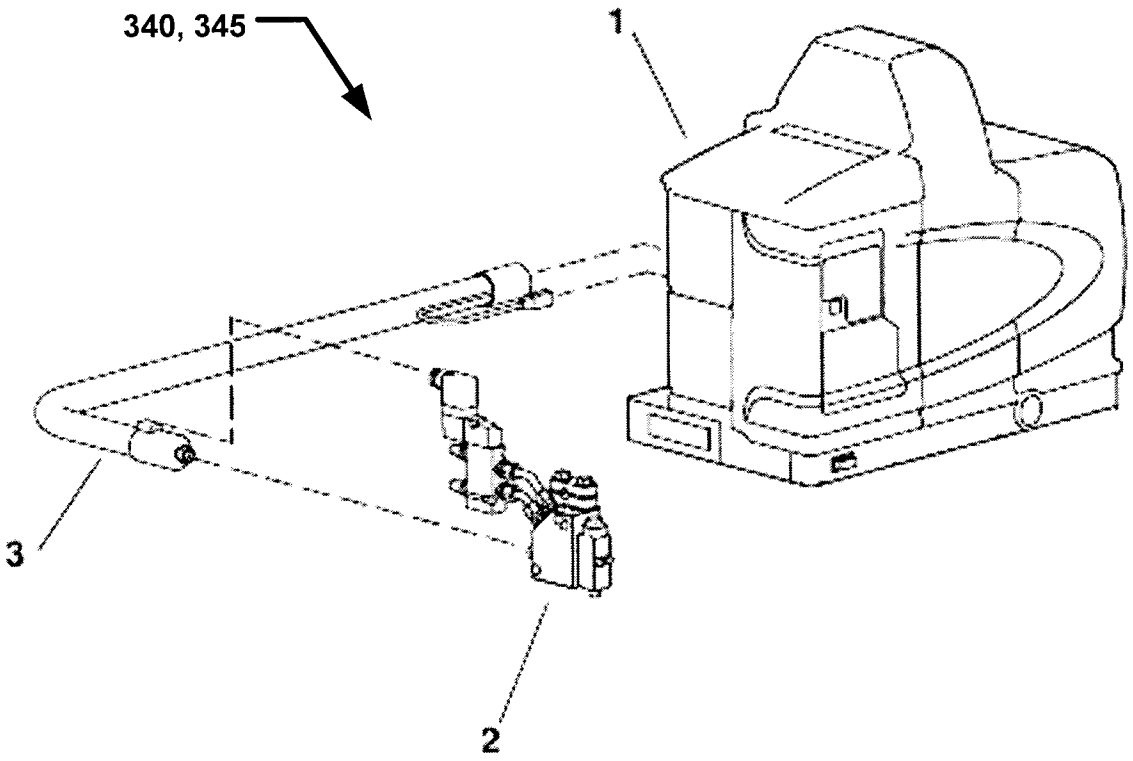
FIG. 3A is a representative drawing of a hot glue application system.

FIG. 3A is a representative glue application system 340 and 345 as shown in FIG. 3. The figures depicts an example of a melter 1 such as a ProBlue® melter make by Nordson Corporation. The melter 1 liquefies solid form hot melt and maintains the hot melt at the desired temperature. When the glue jets 2 are activated, the melter pumps the liquefied hot melt through the hoses 3 and out the jet nozzles, where it is applied to forms 80 and 80*a*. The melt and pump solid form hot melt materials are engineered to be liquefied and extruded at temperatures below 230 degrees Celsius. The glue system is included in the perforation and glue system 150. Other systems, which are commercially available, are used to apply the fugitive glue 60 and the moistenable glue 10.

Figure 3B:
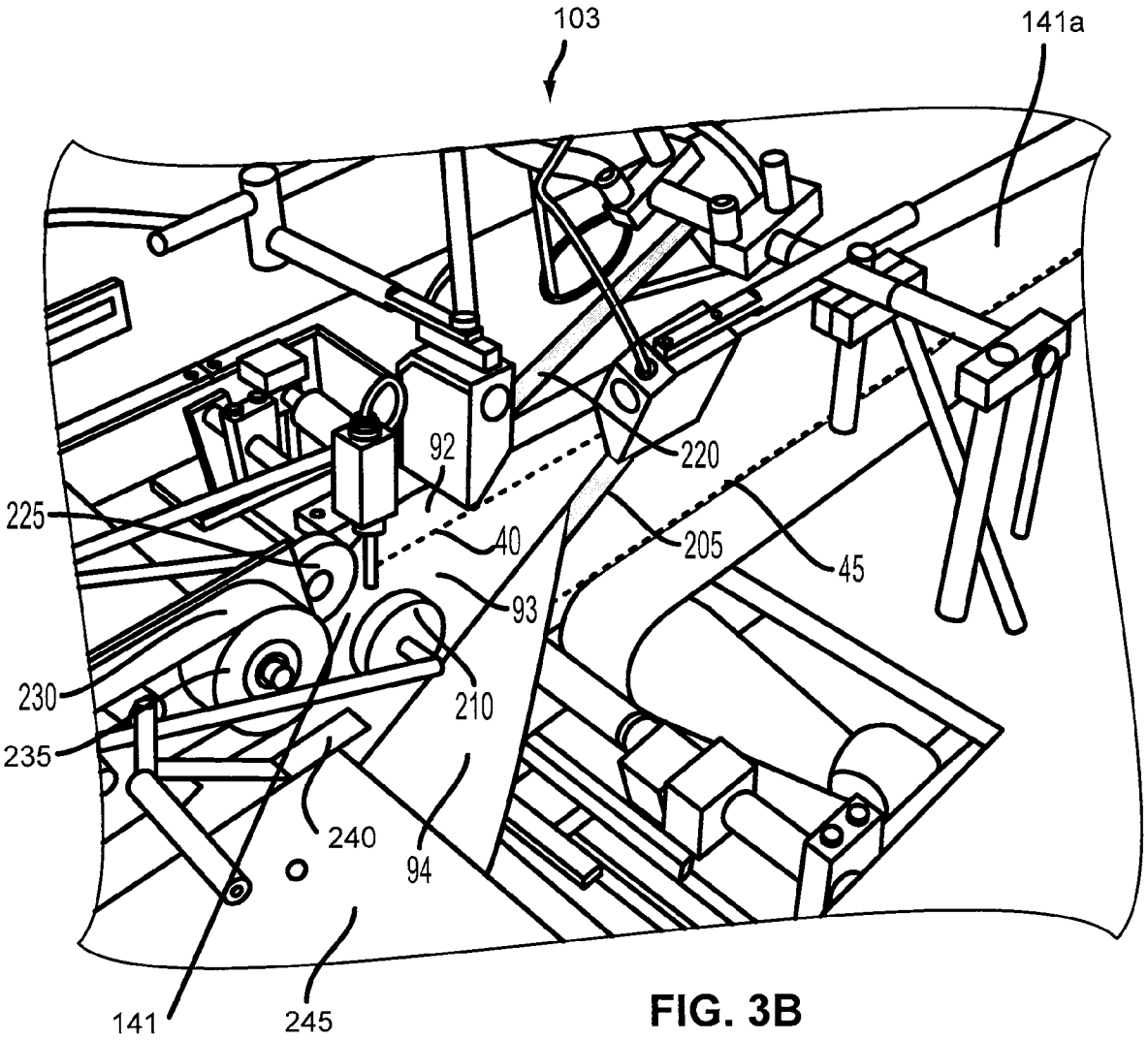
FIG. 3B is a representative drawing of a wrapping system.

FIG. 3B is a representative drawing of a wrapping system 103 which has an input of the continuous paper web 141 and outputs a continuous paper web 141*a* that has been folded and sealed and is ready to be cut into individual mailpieces 170 FIG. 1. The continuous paper web 141 enters the wrapping system 103 from below the deck plate 245 after glue and longitudinal perforations have been applied. The fold line 45, which is between panels 94 and 95, is formed by the creasing and twisting action created between roller 210 and guide member 205. Similarly, fold line 40, which is between panels 92 and 93, is formed by the creasing and twisting action created between roller 225 and guide member 220. Inserts 96, 96*a* and 96*b* (not shown) are inserted onto panel 93 by belt 230 and pulley 235 systems. A bottom belt (not shown) is used below belt 230 to ensure that the inserts are moving at the same speed as the continuous paper web 141. Guide fingers 240 are used to ensure that the inserts are placed flat and oriented correctly as they are placed on the continuous paper web 141. The continuously moving paper web and inserts that transition into a wrapping system enables higher throughput, mailpieces manufactured per hour, than can be achieved by conventional envelope inserters.

Turning now to FIGS. 4A and 4B for a second example of a bidirectional mailpiece which contains a product advertisement 70 with a payment coupon 72. Additional printed materials 82 and 83 (FIG. 2) are omitted to allow for a smaller return mailpiece while maintaining a sufficient area for inserts 96*a*. The return envelope is created by wrapping panel 97 onto panel 98 and sealing glue lines 20*a*, 22*a*. 30*a* and 32*a*. Those skilled in the art may provide printed material on the inside of the return envelope at location 97*a* that will be used when the return envelope is processed at the receiving location. The return address 85 is printed on the back of panel 97. The customer address 87 is printed on the back of panel 99 and the mailpiece instructions 86 are printed on the back of panel 98. The moistenable glue line 10*a* and the fugitive glue line 60*a* are swapped between top and bottom of the form 80*a* versus the orientation shown for 80 (FIG. 2A). The glue lines 20*a*, 22*a*, 30*a* and 32*a* are applied in a similar manner to that already described above. Perforation 35*a* is made on the blank paper or in the perforation and glue system 150. The return mailpiece flap is creased or perforated 55*a* with a perforation wheel or crease rollers. The wrapping sequence is reversed starting with panel 97 being wrapped onto panel 98 along fold line 40*a* and sealing the glue lines 20*a*, 22*a*, 30*a* and 32*a*. The bidirectional mailpiece is completed by wrapping panel 99 along fold line 45*a* and sealing the panel with the fugitive glue line 60*a*. The perforation line 75 is created by the perforation rollers 155. However the perforation cutting blades are shortened to only perforate a single layer and cut from the bottom. The processes of FIG. 3 can be adjusted to accommodate the FIG. 4 form 95*a* configuration by those skilled in the art without significant modification to the wrapping document processing system 100. As shown in FIG. 5 form 90*b*, business reply address features 501, 502 and 503 can easily be added to the return address 510 panel. Feature 501 is a machine readable indicator that this is a business reply mailpiece. Feature 502 is an indication of business reply postage requirements and feature 503 is a human readable indication that the mailpiece is a business reply mailpiece along with an indication of the class of delivery service requested and a permit number for postage billing. This exemplary form 90*b* is processed in a similar manner as the previously described forms with glue strips, perforations, fold lines and flap creases applied by the wrapping system 100 as required.

Figure 6:
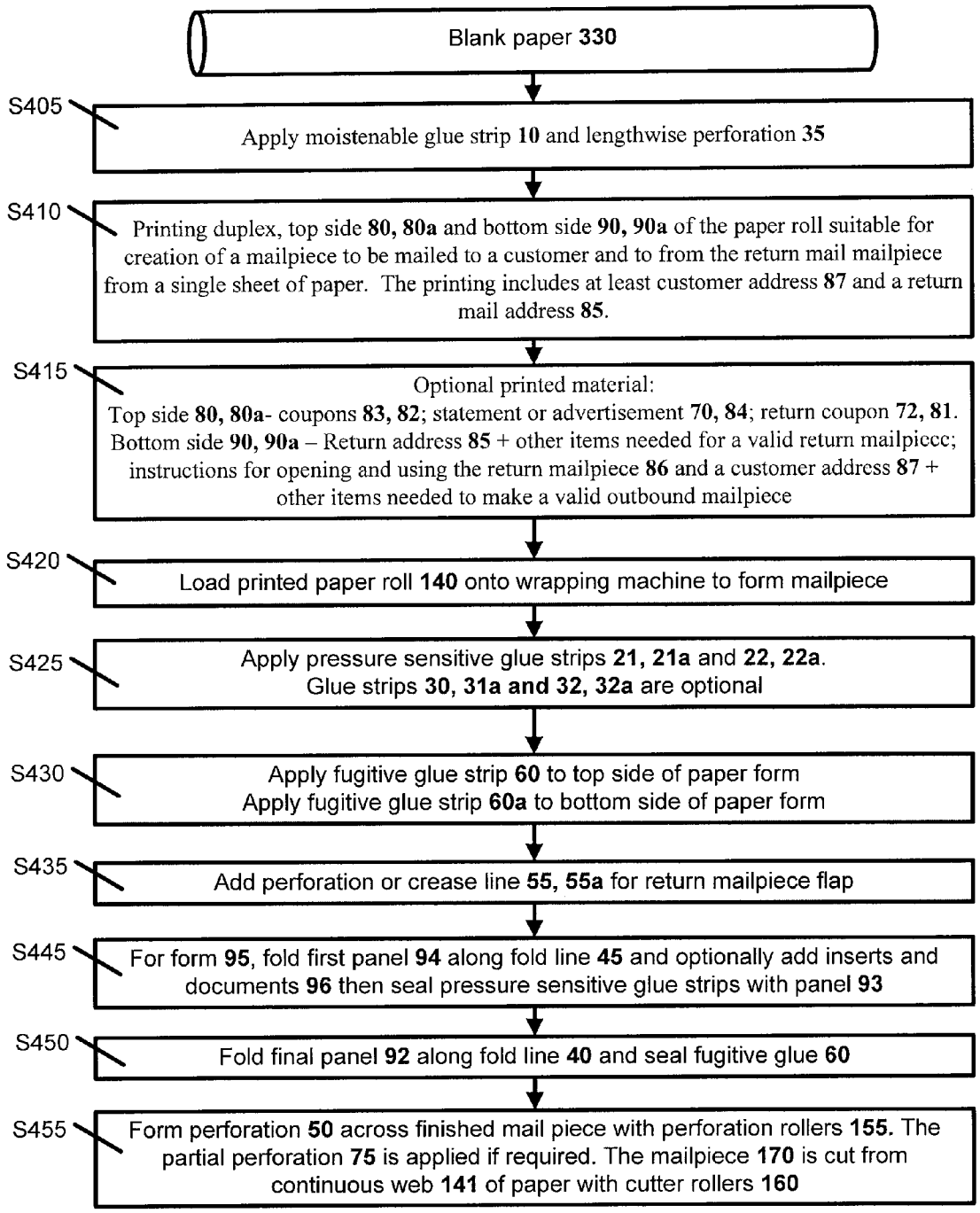
FIG. 6 is an exemplary process flow of the paper roll creation and wrapping document processing system operational steps.

FIG. 6 is a process flow of the paper roll 140 creation and the wrapping document processing system 100 operational steps. This process will produce a bidirectional mailpiece from a single sheet of paper which is cut from a continuous web 141 of paper after the mailpiece is created. Steps S405 through S415 involve the creation of the printed material to be processed on the wrapping document processing system 100. The process starts with a blank paper roll of paper 330. In step S405 a moistenable glue strip 10 is applied and lengthwise perforations 35 are created. These functions also can be performed in the perforation and glue system 150. Step S410 defines the duplex printing of the top side of the paper, forms 80 or 80*a* and the bottom side of the paper with forms 90 or 90*a* which are printed on the roll of paper 332. The roll of paper 332 may have a longitudinal glue strip and perforation, as required by the applications being run on the wrapping document processing system 100. The bottom side forms 90, 90*a* or 90*b* will have at least the customer address and the return address. Form 90*b* (FIG. 5) is only printed on the bottom side hence duplex printing is not required. Step S415 defines the optional printed material that may be added to the printed roll. The top side 80 or 80*a* printed material may include but is not limited to coupons 83, 82; statement or advertisements 70, 84; or return coupons 72, 81. For the bottom side 90, 90*a* or 90*b*, printing may include but is not limited to the return address 85 plus other items needed for a valid return mailpiece; instructions for opening and using the return mailpiece 86; a customer address 87; and other printed items needed to make a valid outbound mailpiece.

Steps S420 through S455 are performed by the wrapping document processing system 100. The paper roll 140 is loaded onto the wrapping machine 100 in step S420. The paper roll 140 contains the duplex printed forms 95 and 95*a* or the single sided form 90*b* plus perforations and glue strips as required by the application. The pressure sensitive glue strips 20, 22, 20*a* and 22*a* are applied in step S425. If contact glue is used, glue strips 30, 32, 30*a*, and 32*a* are applied. If optional printing is used, that step is performed between steps S420 and S425. In step S430, the fugitive glue 60 or 60*a* is applied. In step S435, either a perforation or a crease line 55, 55*a* is applied to make folding of the flap of the return mailpiece easier for the customer to manipulate. The wrapping and folding process is performed on the continuous web 141 of paper forms in step S445. For form 95 (FIG. 2), the first panel 94 is folded along fold line 45 and optional inserts and documents 96 are added before the seal pressure sensitive glue strips 20, 22 are sealed with panel 93. For form 95*a*, the first panel 97 is folded along fold line 40*a* and optional inserts and documents 96*a* are added before the seal pressure sensitive glue strips 20*a*, 22*a* are sealed with panel 98. This process forms the return mailpiece. Step S450 completes the outbound mailpiece 165 for form 95 by folding panel 92 along fold line 40 and then sealing the fugitive glue 60. For form 95*a*, panel 99 is folded along fold line 45*a* and then sealed with the fugitive glue 60*a*.

Step S455 completes the individual outbound mailpiece 170 by forming the perforation 50 across finished mail piece with perforation rollers 155. Alternately the partial perforation 75 is applied if required. The mailpiece 170 is cut from continuous paper web 141 with cutter rollers 160. The order of and processes contained in individual steps can be changed by those skilled in the art to accommodate different form structures and wrapping document processing system configurations.

As shown by the above discussion, functions relating to the preparation of the integrated bi-directional mailpiece may be implemented on one or more computers operating as the control processor 200 connected for data communication with the processing resources as shown in FIG. 1. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data, e.g. files used for the workflow templates for a number of production jobs as well as the various files for tracking data accumulated during one or more productions runs. The software code is executable by the general-purpose computer that functions as the control processor 200 and/or the associated terminal device. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for generating an integrated bidirectional mailpiece, in essentially the manner performed in the implementations discussed and illustrated herein.

Figure 7:
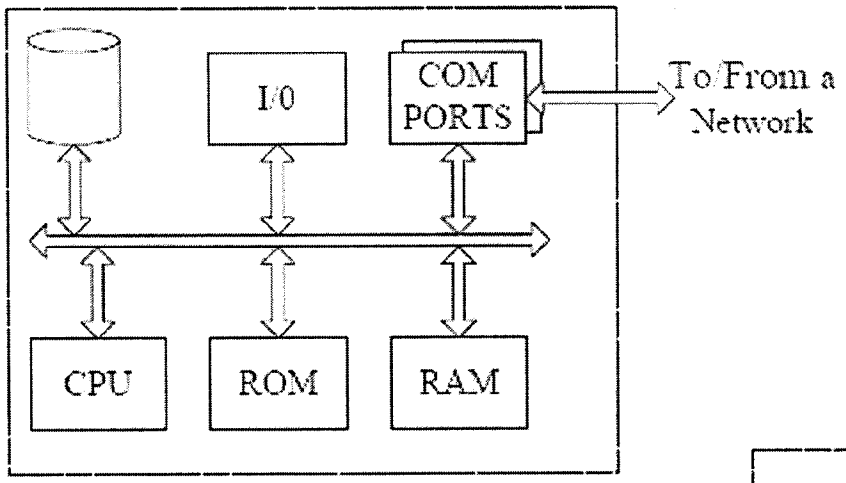
FIG. 7 illustrates a network or host computer platform, as may typically be used to implement a server.
Figure 8:
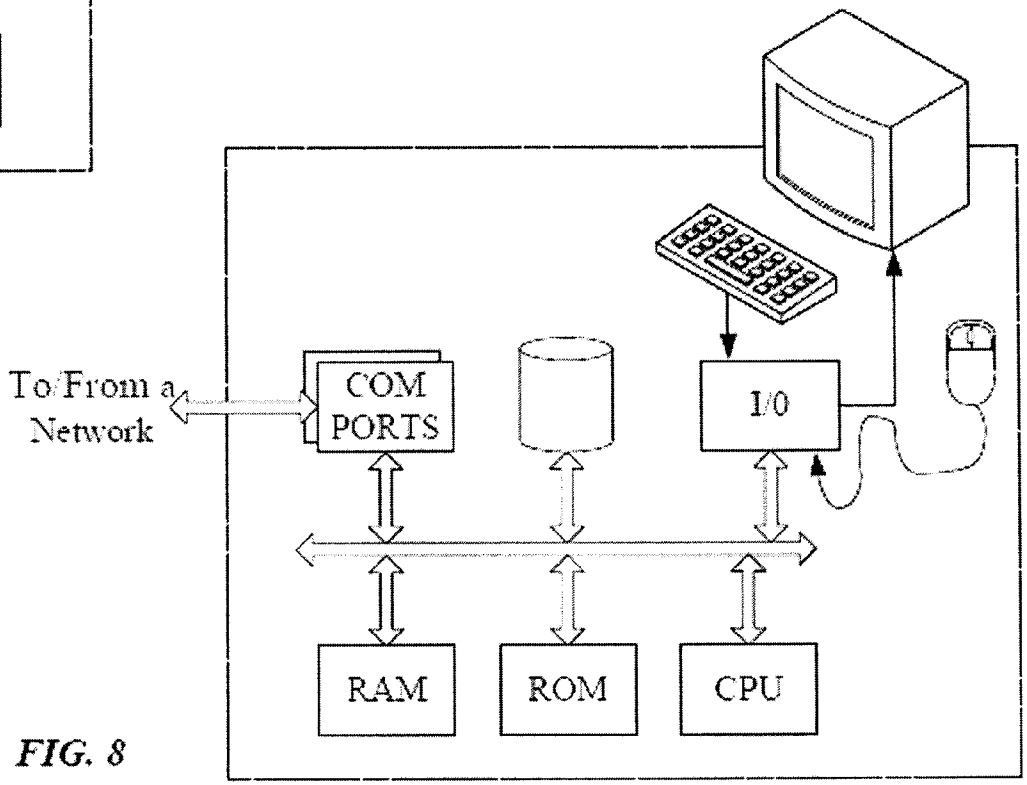
FIG. 8 depicts a computer with user interface elements, as may be used to implement a personal computer or other type of work station or terminal device.

FIGS. 7 and 8 provide functional block diagram illustrations of general purpose computer hardware platforms. FIG. 7 illustrates a network or host computer platform, as may typically be used to implement a server. FIG. 8 depicts a computer with user interface elements, as may be used to implement a personal computer or other type of work station or terminal device, although the computer of FIG. 8 may also act as a server if appropriately programmed. It is believed that those skilled in the art are familiar with the structure, programming and general operation of such computer equipment and, as a result, the drawings should be self-explanatory.

For example, control processor 200 may be a PC based implementation of a central control processing system like that of FIG. 8, or may be implemented on a platform configured as a central or host computer or server like that of FIG. 7. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software as well as data. The mass storage within the computer system may also include one or more drives for various portable media, such as a floppy disk, a compact disc read only memory (CD-ROM), or an integrated circuit non-volatile memory adapter (i.e. PCMCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for generating an integrated bidirectional mailpiece, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps regarding the manufacturing of an integrated bidirectional mailpiece, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A method of producing an integrated bidirectional mailpiece on a wrapping document processing system, the mailpiece having outgoing and return envelope functionality, the method comprising steps of:

printing, by way of a printer, information on both sides of a continuous web of paper, the paper including:

a first panel including a first address for the outgoing envelope, a second panel including a second address for the return envelope, the second address being different from the first address, a third panel between the first and second panels, wrapping, by way of a wrapping section of the wrapping document processing system, the paper along fold lines to form the mailpiece from the continuous web of paper such that the address on the first panel is viewable on an exterior of the mailpiece, and the address on the second panel is concealed in an interior of the mailpiece; and sealing the wrapped paper along one or more adhesive portions positioned along one or more surfaces of the mailpiece, wherein the printed information is customized for an intended recipient at the first address on the outgoing envelope, further comprising the step of:

inserting one or more pages of assembled inserts to be included inside the mailpiece.

2. The method according to claim 1, wherein the printing step includes:

printing a coupon or advertisement on the paper.

3. The method according to claim 1, wherein the printing step includes:

printing instructions for opening the outgoing envelope and assembling the return envelope.

4. A method for producing a bidirectional integrated mailpiece on a wrapping document processing system, the mailpiece having outgoing and return envelope functionality, the method comprising steps of:

receiving a continuous web of pre-printed paper from a paper stock, the pre-printed paper containing a first address for the outgoing envelope in a first panel and a second address for a return envelope in a second panel;

applying at least one adhesive region to a surface of at least one side of the paper;

creating at least one fold line extending across a width of the paper between the first and second panels;

generating a perforated line extending across a width of the paper such that the first panel can be separated from the paper;

wrapping, by way of a wrapping section of the wrapping document processing system, the paper along a plurality of fold lines such that the first address on the first panel is viewable on an exterior of the mailpiece, and the second address on the second panel is concealed in an interior of the mailpiece;

sealing the wrapped sheet along one or more adhesive portions; and cutting the mailpiece, formed by wrapping the continuous web of pre-printed paper, from the paper stock.

5. The method according to claim 4, further comprising the step of forming a perforation across the formed mailpiece prior to the cutting step.

6. The method according to claim 4, further comprising the step of:

inserting one or more pages of assembled inserts to be included inside the mailpiece.

7. A method for producing an article of manufacture for use as an integrated bidirectional mailpiece on a wrapping document processing system, the mailpiece having outgoing and return envelope functionality, the method comprising steps of:

receiving paper from a paper stock;

printing, by way of a printer, a first address on a first panel for the outgoing envelope and printing a second address on a second panel for the return envelope, the second address being different from the first address;

applying one or more adhesive regions to a surface of at least one side of the paper;

creating at least one fold line extending across a width of the sheet of paper between the first and second panels;

generating a perforated line extending across a width of the paper such that the first panel can be separated from the paper;

inserting one or more loose pages of assembled inserts to be included inside the mailpiece; and wrapping, by way of a wrapping section of the wrapping document processing system, the sheet of paper along fold lines such that the address on the first panel is viewable on an exterior of the mailpiece, the address on the second panel is concealed in an interior of the mail piece, and the one or more pages of loose inserts are wrapped within the mail piece.

8. The method according to claim 7, further comprising the step of:

sealing the folded sheet along one or more adhesive portions positioned along one or more surfaces to form the mailpiece.

9. The method according to claim 7, further comprising the step of:

generating a second perforated line.

10. The method according to claim 9, further comprising the step of:

cutting the formed mailpiece such as to be separated from the paper stock.

* * * * *